United States Patent [19]

Smith

[11] Patent Number: 4,951,816

[45] Date of Patent: Aug. 28, 1990

[54] CONVERTIBLE CONTAINER FOR CARRYING CLOTHES AND CARRYING AND PROTECTING VARIOUS LENGTHY ITEMS

[76] Inventor: Harrison C. Smith, 2911 B S. Woodstock St., Arlington, Va. 22206

[21] Appl. No.: 736,353

[22] Filed: May 21, 1985

[51] Int. Cl.[5] ..... B65D 85/18; A45C 7/00

[52] U.S. Cl. ..... 206/279; 190/103; 190/107; 190/111; 190/112; 190/116; 206/315.1; 280/814

[58] Field of Search ..... 150/52 R, 52 G; 190/103, 107, 109, 111, 112, 116; 206/279, 315.1, 315.3; 224/258, 913, 916, 917, 922

[56] References Cited

U.S. PATENT DOCUMENTS

| | | | |
|---|---|---|---|
| 1,562,004 | 11/1925 | Scheuerell | 190/28 |
| 1,705,149 | 3/1929 | Brady | 190/111 |
| 1,914,087 | 6/1933 | Gilmore | 190/111 |
| 2,270,049 | 1/1942 | Greenstein | 150/52 G |
| 2,292,142 | 8/1942 | Matson | 224/922 |
| 2,325,806 | 8/1943 | Simmons | 190/111 |
| 2,495,391 | 1/1950 | Smith | 150/52 R |
| 2,533,850 | 12/1950 | Syracuse | 150/52 R |
| 2,674,288 | 4/1954 | Laidlaw | 150/52 R |
| 2,767,758 | 10/1956 | Haynes | 150/52 G |
| 2,872,960 | 2/1959 | Kolpin | 150/52 R |
| 3,019,869 | 2/1962 | Engelhardt | 190/111 |
| 3,575,327 | 4/1971 | Harrison | 150/52 R |
| 3,837,548 | 9/1974 | Nerger | 206/315.1 |
| 3,870,132 | 3/1975 | Hanley | 190/109 |
| 4,098,376 | 7/1978 | Pelavin | 190/112 |
| 4,153,146 | 5/1979 | Patton et al. | 190/103 |
| 4,182,391 | 1/1980 | Kjose | 150/52 R |
| 4,334,601 | 6/1982 | Davis | 190/111 |
| 4,386,642 | 6/1983 | Durbin | 150/52 R |
| 4,402,355 | 4/1983 | Wymore | 150/52 R |
| 4,424,841 | 1/1984 | Smith | 190/116 |
| 4,483,380 | 11/1984 | Beran | 206/315.1 |

FOREIGN PATENT DOCUMENTS

| | | | |
|---|---|---|---|
| 1116141 | 8/1982 | Canada . | |
| 781765 | 3/1935 | France | 190/109 |
| 1073259 | 9/1954 | France | 190/111 |

*Primary Examiner*—Gary E. Elkins

[57] ABSTRACT

The invention comprises an elongate body adaptable for the carrying and transportation of various lengthy items along with clothes or other related or unrelated items the placement of the latter of which provides a resilient deformable barrier for the protection of the former, and which body includes appropriate compartments, securing means and/or fastening means for the accomplishment of such purposes. Such body is constructed of materials, and comprises appropriate fastening and carrying means, which allow it to be folded along various axes thereof so as to allow it to be configured in a variety of ways for the accomplishment of its purposes.

8 Claims, 4 Drawing Sheets

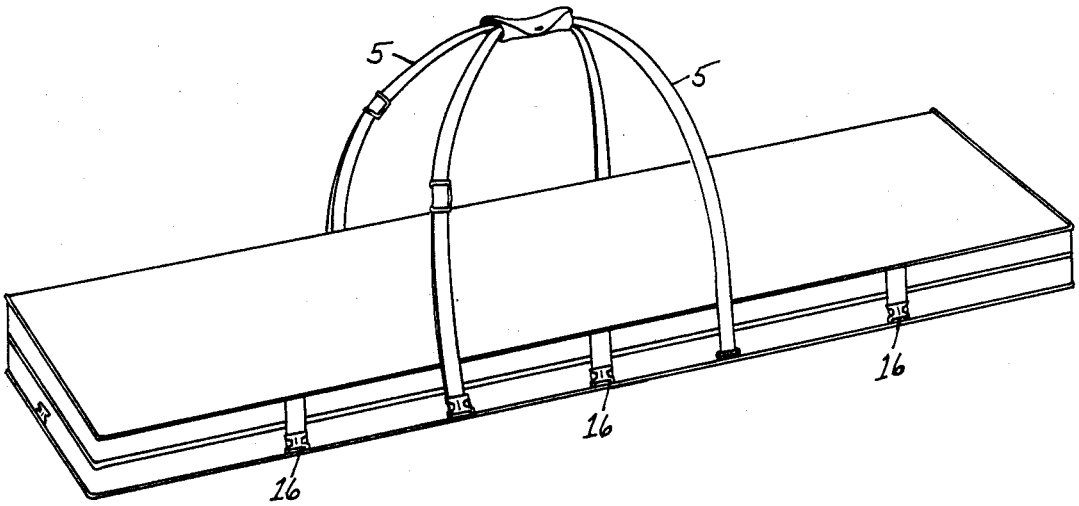
Fig. 8
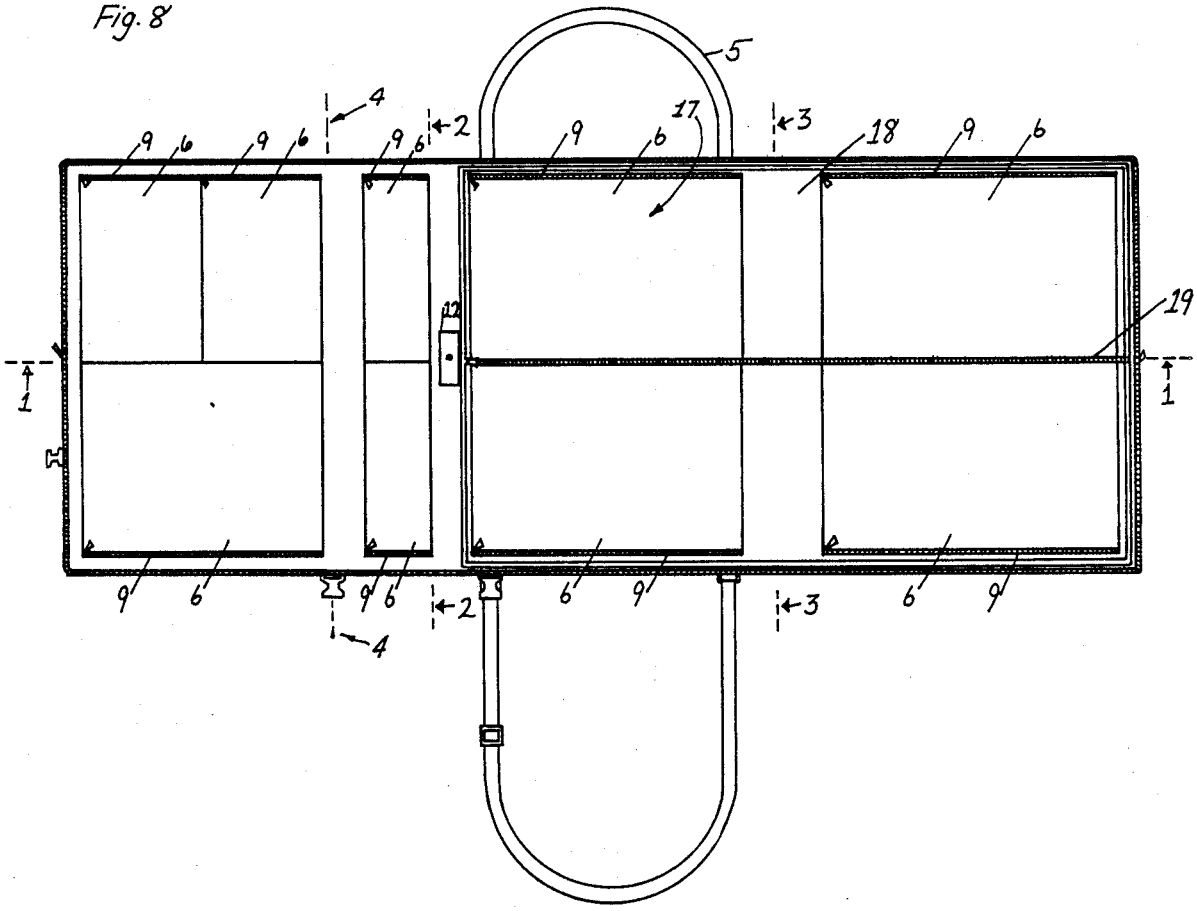

CONVERTIBLE CONTAINER FOR CARRYING CLOTHES AND CARRYING AND PROTECTING VARIOUS LENGTHY ITEMS

BACKGROUND OF THE PRESENT INVENTION

The original idea for the invention stems from the perceived need of skiers for a convenient container in which to carry skis and clothes when travelling by plane, bus or train on ski trips, which container provides for the easy removal of the skis there-from, which can be configured in such a way as to be carriable in automobile trunks or interiors when skis are being carried in exterior racks or are otherwise not required to be in the invention, and which can also be configured to be easily useable as a suitcase, overnight bag, garment bag, etc., when skis are not being carried. When not in use the container folds to a very small size for storing. No presently available container in any way serves or addresses this need. This perceived need is also applicable to the transport of other lengthy items such as other sports equipment, technical or photographic equipment, rolled architectural drawings, etc. The invention meets all these needs. However, for purposes of simplifying the present application, and because it is the primary perceived need, the discussion herein is limited to skis.

The primary commercially available method for carrying and protecting skis is a hollow, generally tubular, container of nylon, canvas or other pliable and durable material and in which skis are placed for shipment. This system provides only minimal protection for the skis in that the outer wall of the container provides little shock absorption. No provision whatsoever is made for the carrying of clothing, toiletries and related items which would be carried on a ski trip. Additionally, the container cannot be used as a suitcase, overnight bag, etc., and is, therefore, useless to its owner during most of the year.

U.S. Pat. No. 4,402,355 attempts to provide protection for skis and the attached bindings by arranging various shock absorbing buffers around them. This arrangement appears to provide additional protection, but it does not provide, as does the current invention, for the carrying of clothes and other travelling items. Nor does it provide for a variety of configurations allowing its use as other than a ski carrier.

Canadian patent No. 1,116,141 comprises a long rigid case which purports to carry skis, or other long items and clothes. This invention provides protection for the skis by surrounding them with the rigid sides of the case. As is true of currently available soft sided ski bags, its interior volume is not compartmentalized and does not provide for the organized carrying of clothes or related articles. The patent merely states that such articles can be placed into the noncompartmentalized interior volume of the case. As is true of the above noted patent, this case provides greater protection for skiing equipment than the bags currently commercially available. However, despite its claim that it is useable to carry clothes, it does not provide the interior compartments or hanging garment hardware to provide for the organized carrying of clothing as does the present invention. Additionally, the large rigid case would be awkward to use and to store and does not provide for convenient use as a garment bag, suitcase or any other nonskiing use, as does the present invention.

The present invention provides for the carrying of clothes and related articles in specially designed interior compartments, including special compartments for hanging garments. It provides for the protection of the skis by surrounding them with the clothes-filled compartments, thus providing shock absorption superior to presently available containers. Additionally, the invention can be folded so as to be useable as a garment bag, overnight bag or ordinary suitcase for non-ski travel.

As described herein, and in the included drawings, the invention is useable for the transport of lengthy items other than skis. Inasmuch as the idea stems primarily from the stated perceived skier need, and inasmuch as it is impossible to describe and depict all other lengthy item applications, this application refers to the carrying of skis and the included drawings show skis in the invention. This is not intended, and should not be construed as a limitation on the use of the invention. The application of the invention to the transport of other lengthy items can be accomplished without modification of the invention as described herein.

BRIEF SUMMARY OF THE INVENTION

A container for carrying clothes or other items and carrying and protecting various lengthy items such as sports equipment (i.e., skis, rifles, etc.), technical equipment (i.e., camera tripods) or other lengthy items not accomodatable within conventional luggage (i.e., rolled architectural plans or drawings, posters, etc.), the outer wall of which container is comprised of a durable and pliable material such as nylon or canvas so as to be foldable into a variety of configurations and containing inside it various sizes and arrangements of pockets and compartments (which in certain embodiments may be attached to the exterior), appropriate attachments for securing such lengthy items, such as tie-downs, interior sleeves, etc., and, in certain embodiments, appliances for securing items stored on hangers. The use of pliable and durable material in construction, arrangement of the compartments and placement of closure systems allows the container to be used in a variety of configurations, from fully extended for very lengthy items, partially extended for medium length items, folded as a conventional suitcase or overnight bag or folded into a garment bag configuration.

BRIEF DESCRIPTION OF THE DRAWINGS

FIG. 7 is a perspective view of the second embodiment of the invention folded across its longitudinal center line.

FIG. 8 is a top view of a third embodiment of the invention, open along its longitudinal center line, showing an alternative arrangement for carrying hanging garments wherein a separate compartment for such garments is provided between the interior compartments and the invention's exterior wall.

DESCRIPTION OF THE PREFERRED EMBODIMENT

Figure 1:
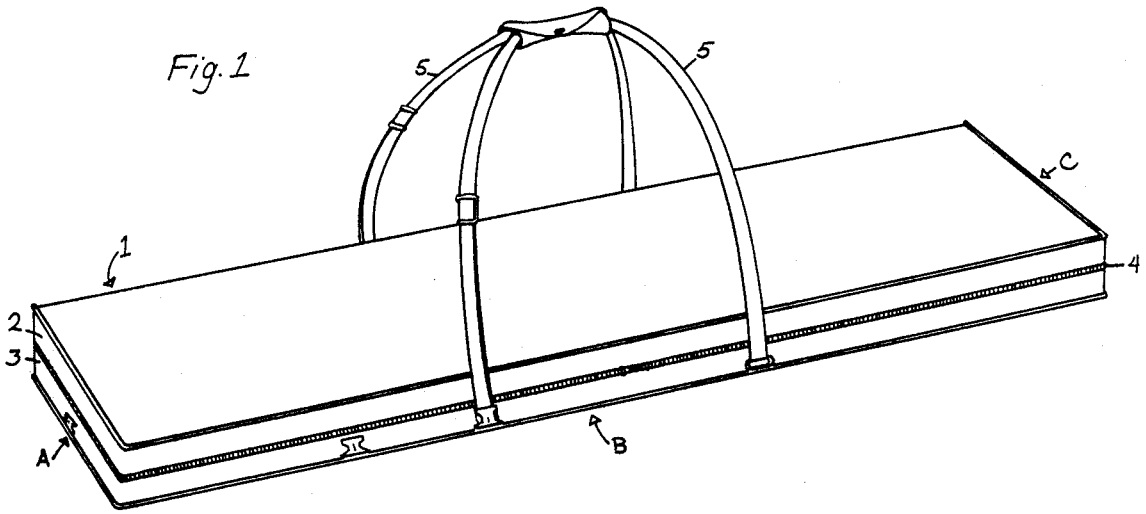
FIG. 1 is a perspective view of the first, third and fourth embodiments of a container according to this invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Likewise, the use of skis in the drawings and descriptions should not be interpreted as limiting the use of the invention which can also be used for other lengthy items as previously described herein.

The reference numeral 1 generally designates a container for the carrying of skis, related equipment and clothing. The container is an elongate body which may be rectangular, round, elliptical or other shape in cross section, comprised of an upper section 2 and a lower section 3 joined on 3 sides (A, B and C) by a zipper, or other closing means 4, and hinged on the 4the side by a fabric connection or other hinging arrangement. The invention may also be made with only side B being openable. In the fifth and sixth embodiments it is possible to have only either end A or C equipped with a communicating aperture while the other sides are sealed. A handle, strap or other carrying means 5, which may be adjustable and may be capable of being attached at various points on the body, is provided for carrying the container. The carrying means may also be attachable at various points on the exterior of the container to compensate for different weight distribution in different configurations. The outer wall is constructed of a flexible material, preferably durable and waterproof.

Figure 2:
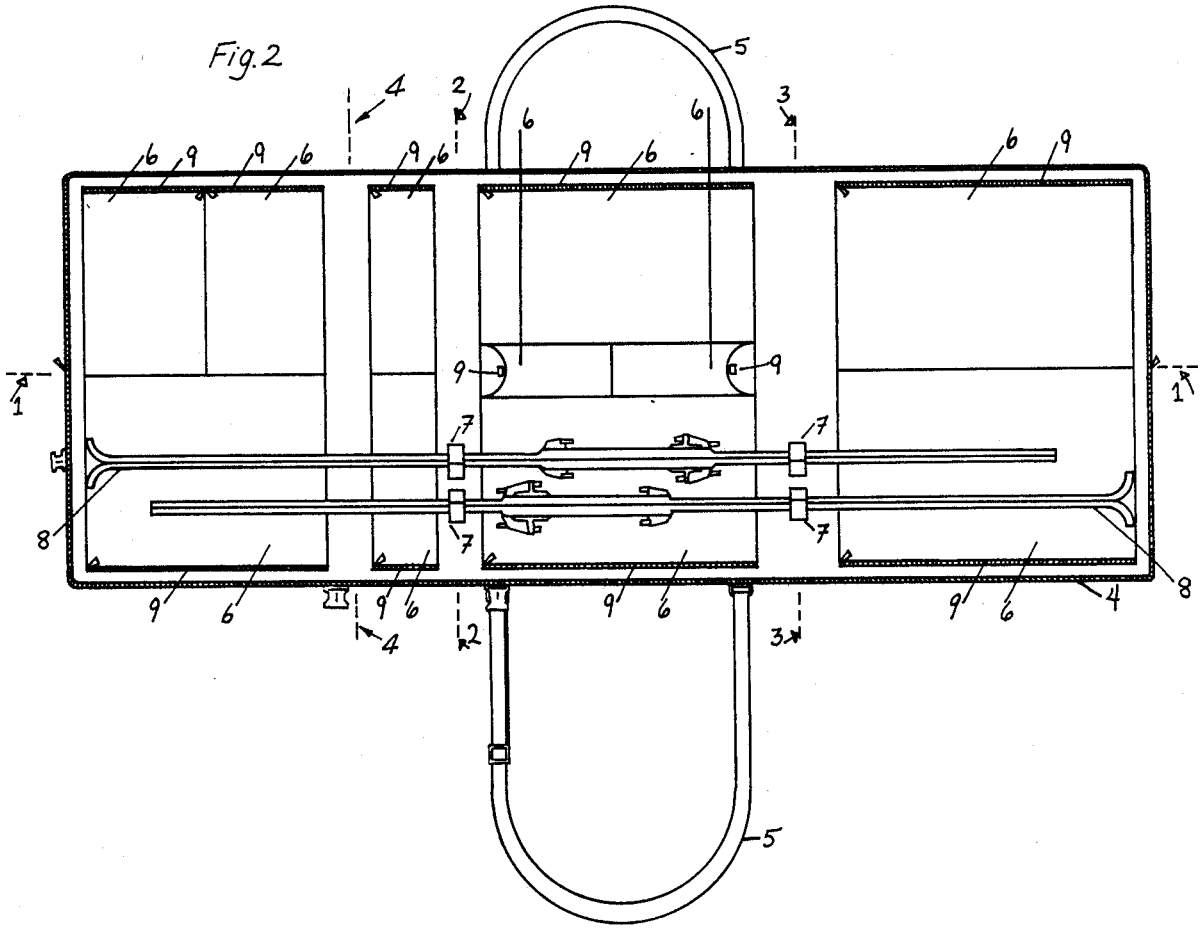
FIG. 2 is a top view of the interior of the first and sixth embodiments of the container which has been opened along its longitudinal center line.

Upon releasing the closing means 4, the container may be along its longitudinal center line, line 1, to expose its interior, as shown in FIG. 2. The interior of the container contains compartments 6 and tie downs, velcro or other securing means 7 for the securing of skis 8 therein,, The compartments 6 are fastened by zippers, flaps, velcro fasteners, snaps or other fasteners 9, and may be divided along the longitudinal center line, line 1, or otherwise.

Figure 3:
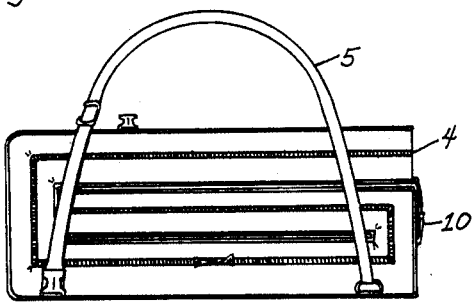
FIG. 3 is a side elevational view of all embodiments of the invention folded across its longitudinal center line and three transverse axes.
Figure 4:
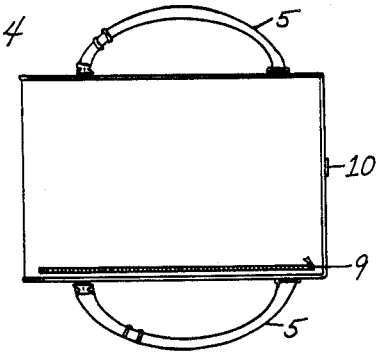
FIG. 4 is a top view of the folded configuration of FIG.
Figure 5:
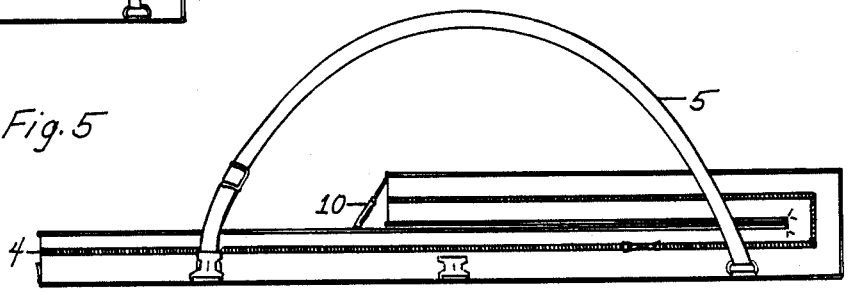
FIG. 5 is a side elevational view of all embodiments of the invention folded across its longitudinal center line and one of its transverse axes.

When skis are not being carried, the container may be configured as a suitcase or overnight bag by folding longitudinally across line 1 and then folding across transverse line 3, followed by folding across transverse lines 2 and 4, fastened by a strap or other fastener 10 as shown in FIG. 3. It may also be configured as an intermediate length container by folding longitudinally across line 1 and transversely across either line 2 or line 3 only preferably line 3, as shown, and fastened by fastening means 10 as shown in FIG. 5.

Figure 6:
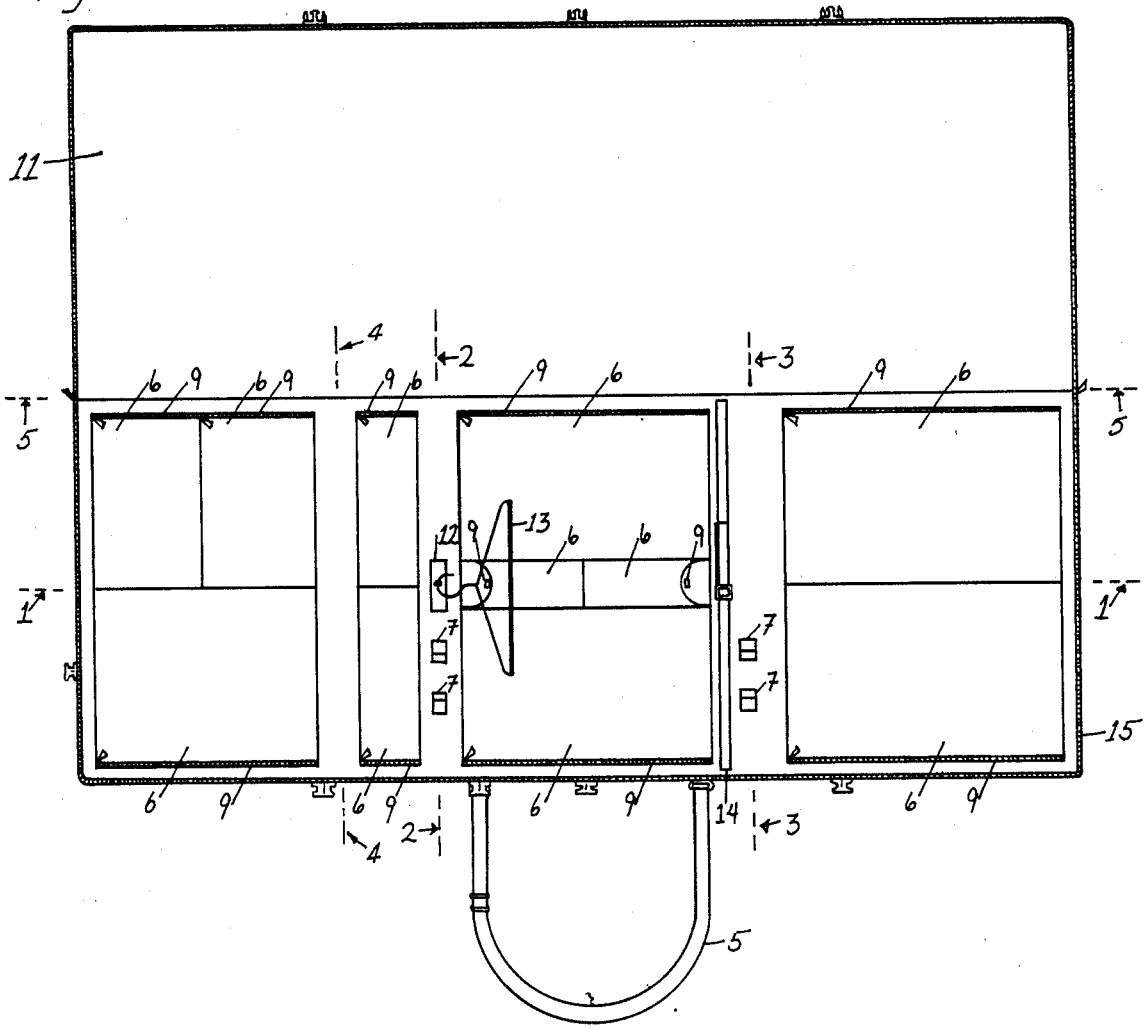
FIG. 6 is a top view of a second embodiment of the invention showing it with its full length flap open to expose its interior, and also showing a hook or other hardware for the carrying of hanging garments.

FIG. 6 shows a second embodiment of the invention designed to provide for the carrying of hanging garments, which may be contained in plastic bags or other such protective enclosure, by the addition of a full length covering flap 11, hinged at Line 5, hardware 12 for attachment of hangers 13, and may include a strap 14 or other device for securing hanging garments. The flap may be attached at any edge of the container or may be split in two, attached at opposite edges and joined in the center.

With the flap folded along line 5 and secured by zipper or other securing means 15, this embodiment may be folded along line 1 and secured by a plurality of longitudinally spaced straps 16 as shown in FIG. 7.

A third embodiment of the invention is shown in FIG. 8 wherein a separate compartment 17 for hanging garments is provided by the addition of an additional interior wall 18 covering two of the interior compartments 6 which wall is comprised of a flexible, durable material divided longitudinally by a zipper or other fastener 19 for access to the compartments 6. Alternatively, the compartment wall could be one piece appropriately attached to the container exterior wall on one side thereof and fitted with a fastener on its opposite side. The compartment 17 could also be constructed to occupy a space between the compartments 6 and the exterior wall of the container by attaching the walls of such compartments 6 to the interior wall 18 of the hanging garment compartment 17 and providing a zipper or other appropriate fastener 19 down the center of interior wall 18 or on one or more sides of the perimeter thereof.

Figure 9:
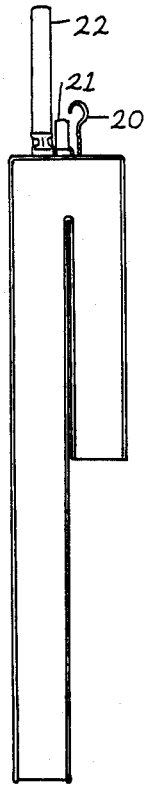
FIG. 9 is a side elevational view of the second and third embodiments of the invention configured for hanging by folding across one transverse axis thereof.
Figure 10:
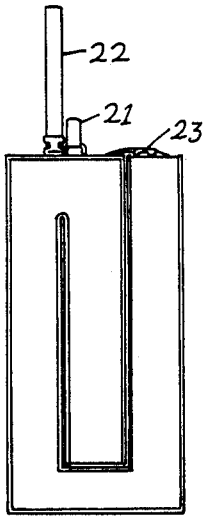
FIG. 10 is a side elevational view of the second and third embodiments of the invention configured for carrying by folding across two transverse axes thereof.

Either the second or the third embodiments (including the alternative arrangements thereof) may be configured for hanging in a closet or elsewhere by folding across line 2, (without first folding across line 1) and using the hanger 20, which hanger may be permanently attached or detachable, such configuration being shown in FIG. 9.

By folding across line 3 in addition to line 2 (again without folding across line 1) the invention is configured for carrying by handle 21 or shoulder strap 22. A strap or other fastener 23 holds the container in this configuration. The shoulder strap 22 and handle 21 may be removable or adjustable.

Figure 11:
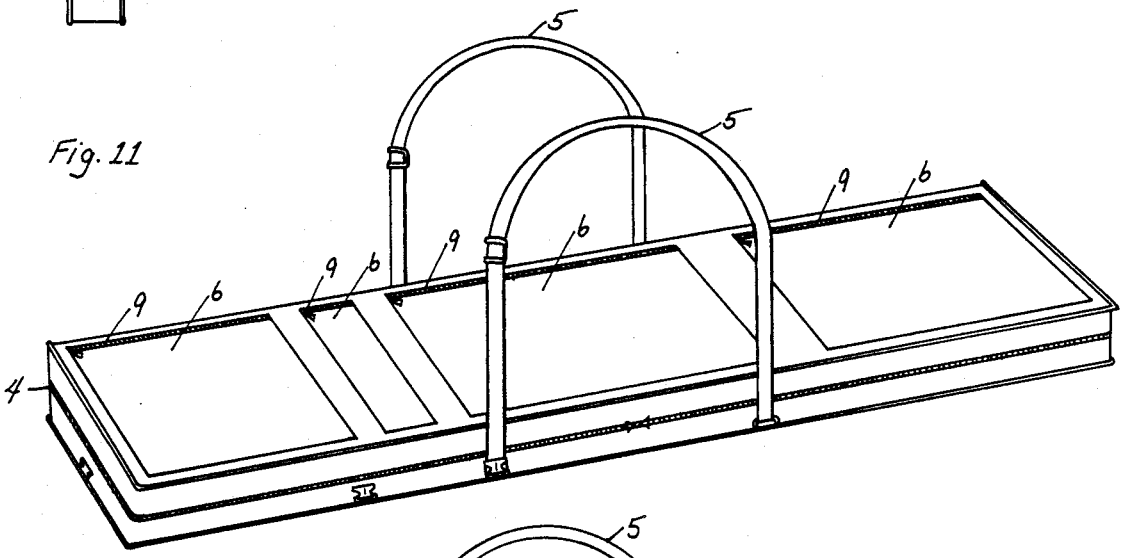
FIG. 11 is a perspective view of a fifth embodiment of the invention wherein the pockets and compartments are arranged along the exterior thereof.
Figure 12:
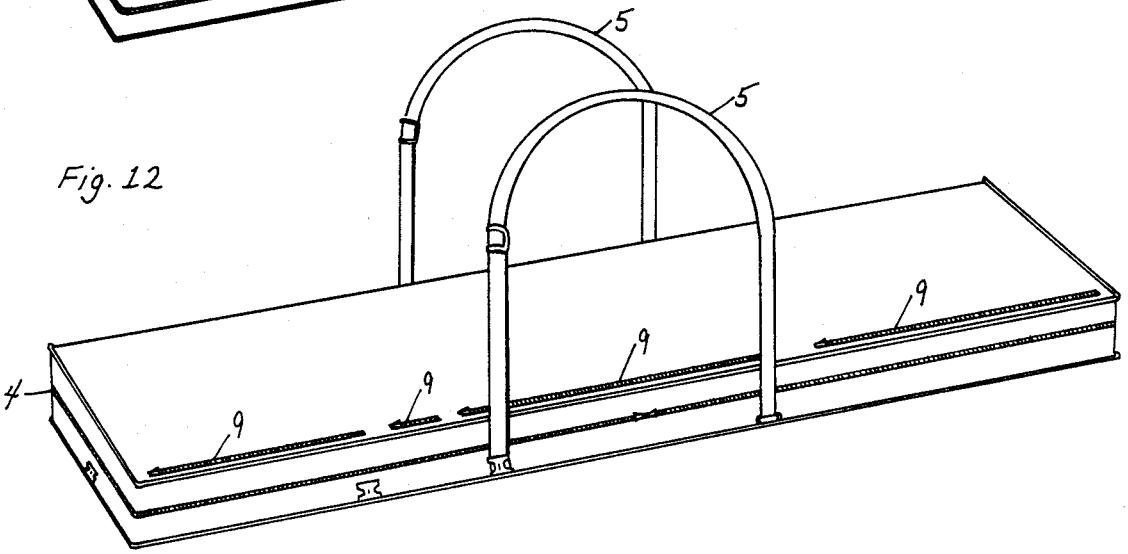
FIG. 12 is a perspective view of a sixth embodiment of the invention wherein access to the interior pockets and compartments is provided by means of communicating apertures in the exterior wall thereof.

FIGS. 11 and 12 show fourth and fifth embodiments respectively of the container. In the fourth embodiment the compartments 6 are arranged along the exterior of the container. In the fifth embodiment communicating apertures through the exterior walls of the container provide access to interior compartments.

In using the container for ski trips a skier can place his/ her clothes, equipment and other items into the interior compartments 6. Hanging garments are attached to the hanging appliance 12 by use of the hangers 13 and either secured by the strap 14 in the second embodiment or enclosed in the hanging garment compartment 17 in the third embodiment (either alternative). The skis and poles are then placed in the container and secured by means of the tie downs 7. The container is folded across line 1 and secured by means of the closure systems 4 and/or 16. In such configuration the container may be carried by adjustable handles or shoulder strap 5. In such configuration the container is well suited for shipment by airplane, bus, train or other common carrier in that the clothes provide a shock absorbing buffer protecting the skis.

Upon arrival at the terminal the skier may transfer the container, without reconfiguration, to bus or other transport to the final destination if such means of transport provides for carrying the container in such configuration. Alternatively, if the skis are to be carried in an automobile roof rack or are otherwise to be removed from the container the user can easily open the closure systems 4 and/or 16, release the tie downs 7 and remove the skis 8. The container is then refolded across line 1 and the closure systems 4 and/or 16 are refastened. The, container is then folded across lines 3, 2 and 4 in sequence and fastener 10 is secured to hold the container in its suitcase type configuration. In such configuration it can be conveniently carried by means of the handle or strap 5 or stored in automobile trunk, bus, or train interior luggage rack, airplane interior luggage compartments, etc. In this configuration the invention can also be used as a suitcase on nonskiing trips.

The second and third embodiments shown in FIGS. 6 through 10 can also be used to carry hanging garments by means of the interior appliance 12 provided therefore and by using the strap 14 provided in the second embodiment or the separate compartment 17 in the third embodiment. Skis can still be carried by use of the tie downs 7 and folding across line 1. Additionally, by folding across line 2 and using the hanger 20 the container can be hung as a conventional hanging garment bag and by additionally folding across line 3 and fastening the fastener 23 and by using the handle 21 or shoulder strap 22 can be carried in the same fashion as a conventional garment bag.

It is to be understood that while certain preferred embodiments of the invention have been illustrated and described herein, it is not limited to the specific forms or arrangements and configurations described and shown, nor is its use limited to skis, clothes and the other items expressly mentioned herein. All elements described may be of various sizes and arrangements and may be interior, exterior or combinations thereof. The container may be of various lengths and may fold across more than one longitudinal axis and more than one or more transverse axes.

What is claimed and desired to secure by Letters Patent is:

1. A container for carrying clothes, equipment, toiletries and other items with skis or other lengthy items, comprising:

(a) an elongated outer housing having a length longer than the lengthy items to be carried therein, said length being longer than that of standard length skis, said housing being foldable about a longitudinal axis thereon to fold from an open position to a closed position and being foldable about at least three transverse axes thereof to at least one folded configuration;

(b) housing fastening means for allowing the housing to be opened to the open position thereof when said fastening means is open and fastening said housing in the closed position thereof when said fastening means is closed; (c) at least three interior compartments disposed on said housing on the side thereof which is the interior when said housing is in the closed position, at least one of said compartments being disposed between one longitudinal end and the first of said transverse axes, at least one of said compartments being disposed between said first and second transverse axes or said second and third transverse axes, and at least one of said compartments being disposed between the third transverse axis and the other longitudinal end of the container, said compartments and axes being sized and disposed such that the fully folded configuration is about one third the length of the unfolded configuration; and (d) securing means disposed on said housing on the side thereof which is the interior when said housing is in the closed position, for securing said lengthy items therein;

whereby clothes, equipment, toiletries and other items may be carried in said interior compartments at the same time that said skis or other lengthy items are secured inside said housing by said securing means, and when the lengthy items are not present, the clothes and other items may be carried with the housing in the folded configuration.

2. A container in accordance with claim 1, containing at least four interior compartments, at least one being disposed between one longitudinal end and the first of said transverse axes, at least one each being disposed between said first and second transverse axes and said second and third transverse axes and at least one being disposed between the third transverse axis and the other longitudinal end of the container.

3. A container in accordance with claim 1, wherein said interior compartments are fitted with compartment fastening means releasably fastening said compartments against access to the interior thereof.

4. A container in accordance with claim 1, further including exterior fastening means for securing said housing in any of said at least one folded configurations.

5. A container in accordance with claim 1, further including exterior carrying means for facilitating carrying said housing, said exterior carrying means being adjustable and transferable among several attachment locations on said housing.

6. A container in accordance with claim 5, wherein said exterior carrying means comprise first and second straps releasably connected on the longitudinally extending sides of said housing, when in a closed position, one said strap to a side, said attachment locations including at least three locations on each said longitudinal side of said housing.

7. A container in accordance with claim 1, wherein said housing contains an aperture providing access through the exterior of said housing directly into one of said interior compartments, and further including aperture fastening means for selectively opening and fastening said aperture.

8. A container in accordance with claim 1, further including one or more exterior compartments arranged on the exterior of said housing when closed.

* * * * *